US011439183B2

(12) United States Patent
Woodcock

(10) Patent No.: US 11,439,183 B2
(45) Date of Patent: Sep. 13, 2022

(54) VAPOR PROVISION SYSTEM

(71) Applicant: BRITISH AMERICAN TOBACCO (INVESTMENTS) LIMITED, London (GB)

(72) Inventor: Dominic Woodcock, London (GB)

(73) Assignee: NICOVENTURES TRADING LIMITED, London (GB)

( * ) Notice: Subject to any disclaimer, the term of this patent is extended or adjusted under 35 U.S.C. 154(b) by 370 days.

(21) Appl. No.: 16/485,045

(22) PCT Filed: Jan. 30, 2018

(86) PCT No.: PCT/GB2018/050262
§ 371 (c)(1),
(2) Date: Aug. 9, 2019

(87) PCT Pub. No.: WO2018/146453
PCT Pub. Date: Aug. 16, 2018

(65) Prior Publication Data

US 2020/0037667 A1 Feb. 6, 2020

(30) Foreign Application Priority Data

Feb. 10, 2017 (GB) ..... 1702206

(51) Int. Cl.
*A24F 40/30* (2020.01)
*G08B 5/40* (2006.01)
(Continued)

(52) U.S. Cl.
CPC ..... *A24F 40/30* (2020.01); *A24F 40/53* (2020.01); *G08B 5/40* (2013.01); *G08B 21/182* (2013.01); *A24F 40/10* (2020.01)

(58) Field of Classification Search
CPC ..... A24F 40/30; A24F 40/53; A24F 40/10; A24F 40/42; A24F 40/51; A24F 47/00; G08B 5/40; G08B 21/182; A24B 15/167
See application file for complete search history.

(56) References Cited

U.S. PATENT DOCUMENTS 2,250,034 A 7/1941 Rich
3,347,231 A 10/1967 Chang
(Continued)

FOREIGN PATENT DOCUMENTS

BR 8201451 A 7/1982
CA 2641869 5/2010
(Continued)

OTHER PUBLICATIONS

UK ECIG Store, Dark Ronin Modz Dual Triton Box Mod, retrieved on Aug. 8, 2019 at https://www.ukecigstore.com/dark-ronin-modz-dual-triton-box-mod.html, 1 page.
(Continued)

*Primary Examiner* — Ojiako K Nwugo
(74) *Attorney, Agent, or Firm* — Patterson Thuente Pedersen, P.A.

(57) ABSTRACT

A vapor provision system configured to selectively generate differently-flavored vapors for inhalation by a user and to make use of this ability to provide user feedback. The system includes a first vapor precursor material having a first flavor and a second vapor precursor material having a second, different, flavor one or more vaporizers arranged to generate vapor from a selectable ratio of the first and second vapor precursor materials to provide a vapor with a selectable flavor for normal use; and control circuitry configured to determine if a user notification condition arises for the vapor provision system, such as a low battery warning, and in response to determining a user notification condition has arisen, to control the at least one vaporizer to generate a
(Continued)

vapor using a modified ratio of the first and second vapor precursor materials to provide a vapor with a different flavor by way of an indication that a user notification condition has arisen.

18 Claims, 4 Drawing Sheets

(51) Int. Cl.

| | |
|---|---|
| ***G08B 21/18*** | (2006.01) |
| ***A24F 40/53*** | (2020.01) |
| *A24F 40/10* | (2020.01) |

(56) References Cited

U.S. PATENT DOCUMENTS

| | | | |
|---|---|---|---|
| 3,876,363 | A | 4/1975 | La Haye |
| 4,482,315 | A | 11/1984 | Day |
| 5,002,048 | A | 3/1991 | Makiej |
| 5,345,951 | A | 9/1994 | Serrano et al. |
| 5,429,122 | A | 7/1995 | Zanen |
| 5,441,060 | A | 7/1995 | Zanen |
| 5,743,251 | A | 4/1998 | Howell |
| 5,810,018 | A | 9/1998 | Monte |
| 5,894,841 | A | 4/1999 | Voges |
| 6,325,475 | B1 | 12/2001 | Hayes |
| 6,390,453 | B1 | 5/2002 | Frederickson |
| 10,251,426 | B2 | 4/2019 | Nielsen |
| 10,306,925 | B2 | 6/2019 | Borkovec et al. |
| 10,368,581 | B2 | 8/2019 | Rostami et al. |
| 10,433,580 | B2 | 10/2019 | Kobal et al. |
| 10,433,585 | B2 | 10/2019 | Tucker et al. |
| 10,786,010 | B2 | 9/2020 | Hubbard et al. |
| 2003/0106552 | A1 | 6/2003 | Murphy |
| 2004/0118396 | A1 | 6/2004 | Hughes |
| 2005/0263618 | A1 | 12/2005 | Spallek |
| 2005/0274378 | A1 | 12/2005 | Stanley |
| 2006/0207596 | A1 | 9/2006 | Lane |
| 2006/0231090 | A1 | 10/2006 | King |
| 2007/0062548 | A1 | 3/2007 | Hortmann |
| 2007/0154407 | A1 | 7/2007 | Peters |
| 2008/0223953 | A1 | 9/2008 | Akira |
| 2008/0241255 | A1 | 10/2008 | Rose |
| 2008/0268060 | A1 | 10/2008 | Tung |
| 2009/0266358 | A1 | 10/2009 | Sacristan Rock et al. |
| 2009/0301471 | A1 | 12/2009 | Stirzel |
| 2010/0319686 | A1 | 12/2010 | Schennum |
| 2011/0309157 | A1 | 12/2011 | Yang |
| 2012/0048266 | A1 | 3/2012 | Alelov |
| 2012/0055467 | A1 | 3/2012 | Gaetano |
| 2012/0291791 | A1 | 11/2012 | Pradeep |
| 2013/0056005 | A1 | 3/2013 | Knudsen |
| 2013/0192615 | A1 | 8/2013 | Tucker et al. |
| 2013/0319431 | A1 | 12/2013 | Gilbert |
| 2013/0331771 | A1 | 12/2013 | Kirk |
| 2013/0333700 | A1 | 12/2013 | Buchberger |
| 2013/0340778 | A1 | 12/2013 | Qiuming |
| 2014/0000638 | A1 | 1/2014 | Don |
| 2014/0060527 | A1 | 3/2014 | Liu |
| 2014/0060554 | A1 | 3/2014 | Collett |
| 2014/0060556 | A1 | 3/2014 | Liu |
| 2014/0083441 | A1 | 3/2014 | Firas |
| 2014/0123989 | A1 | 5/2014 | Lamonthe |
| 2014/0190503 | A1 | 7/2014 | Yonghai |
| 2014/0224248 | A1 | 8/2014 | Edwards |
| 2014/0261408 | A1 | 9/2014 | Depiano |
| 2014/0261488 | A1 | 9/2014 | Tucker |
| 2014/0261493 | A1 | 9/2014 | Smith et al. |
| 2014/0290650 | A1 | 10/2014 | Ivey |
| 2014/0299142 | A1 | 10/2014 | Dincer |
| 2014/0305429 | A1 | 10/2014 | Lewis |
| 2014/0360514 | A1 | 12/2014 | Zhu |
| 2014/0366898 | A1 | 12/2014 | Zhu |
| 2015/0027454 | A1 | 1/2015 | Li et al. |
| 2015/0040926 | A1 | 2/2015 | Saydar |
| 2015/0047662 | A1 | 2/2015 | Hopps |
| 2015/0053217 | A1 | 2/2015 | Steingraber |
| 2015/0090253 | A1 | 4/2015 | Farrow |
| 2015/0114407 | A1 | 4/2015 | Duncan |
| 2015/0114409 | A1 | 4/2015 | Brammer |
| 2015/0144145 | A1 | 5/2015 | Chang |
| 2015/0164141 | A1 | 6/2015 | Newton |
| 2015/0176436 | A1* | 6/2015 | Palmer ..... F01K 7/16 60/654 |
| 2015/0196055 | A1 | 7/2015 | Qiuming |
| 2015/0223521 | A1 | 8/2015 | Menting |
| 2015/0245654 | A1 | 9/2015 | Memari |
| 2015/0257447 | A1 | 9/2015 | Sullivan |
| 2015/0257451 | A1* | 9/2015 | Brannon ..... A24F 40/30 131/328 |
| 2015/0258287 | A1 | 9/2015 | Shichor |
| 2015/0272220 | A1* | 10/2015 | Spinka ..... A24F 40/53 131/329 |
| 2015/0282530 | A1 | 10/2015 | Johnson |
| 2015/0292084 | A1 | 10/2015 | Glaudel et al. |
| 2015/0305406 | A1 | 10/2015 | Yonghai |
| 2015/0313282 | A1 | 11/2015 | Ademe et al. |
| 2016/0089508 | A1 | 3/2016 | Smith et al. |
| 2016/0198771 | A1 | 7/2016 | Goggin et al. |
| 2016/0206001 | A1 | 7/2016 | Eng et al. |
| 2016/0235121 | A1 | 8/2016 | Rogan et al. |
| 2016/0262454 | A1* | 9/2016 | Sears ..... A61M 11/042 |
| 2016/0309782 | A1 | 10/2016 | Malgat et al. |
| 2016/0330999 | A1* | 11/2016 | Cameron ..... A24F 40/30 |
| 2016/0331026 | A1* | 11/2016 | Cameron ..... A24F 40/30 |
| 2016/0338407 | A1 | 11/2016 | Kerdemelidis |
| 2016/0356751 | A1* | 12/2016 | Blackley ..... A24F 40/48 |
| 2016/0360791 | A1* | 12/2016 | Blackley ..... G01N 30/02 |
| 2016/0361452 | A1* | 12/2016 | Blackley ..... A61L 9/032 |
| 2016/0361677 | A1* | 12/2016 | Blackley ..... F24F 3/16 |
| 2016/0361678 | A1* | 12/2016 | Blackley ..... A24F 40/51 |
| 2016/0361972 | A1* | 12/2016 | Blackley ..... B60H 1/247 |
| 2016/0363332 | A1* | 12/2016 | Blackley ..... F24F 3/16 |
| 2016/0363339 | A1* | 12/2016 | Blackley ..... H04L 67/20 |
| 2016/0363567 | A1* | 12/2016 | Blackley ..... A24F 40/51 |
| 2016/0363570 | A1* | 12/2016 | Blackley ..... A24F 40/65 |
| 2016/0363582 | A1* | 12/2016 | Blackley ..... G01N 33/497 |
| 2016/0363917 | A1* | 12/2016 | Blackley ..... G06Q 30/0601 |
| 2016/0374401 | A1 | 12/2016 | Liu |
| 2017/0027232 | A1 | 2/2017 | Scheck et al. |
| 2017/0064994 | A1* | 3/2017 | Xu ..... B65D 25/08 |
| 2017/0095004 | A1 | 4/2017 | Liu |
| 2017/0150755 | A1 | 6/2017 | Batista |
| 2017/0251721 | A1 | 9/2017 | Rostami et al. |
| 2017/0251726 | A1 | 9/2017 | Nielsen |
| 2017/0360981 | A1* | 12/2017 | Avidor ..... A61L 9/012 |

FOREIGN PATENT DOCUMENTS

| | | | |
|---|---|---|---|
| CN | 1362609 | A | 8/2002 |
| CN | 2610293 | Y | 4/2004 |
| CN | 200975836 | Y | 11/2007 |
| CN | 201302362 | Y | 9/2009 |
| CN | 202738816 | | 2/2013 |
| CN | 203378558 | | 1/2014 |
| CN | 103783673 | | 5/2014 |
| CN | 203789150 | | 8/2014 |
| CN | 203860452 | | 10/2014 |
| CN | 203873006 | | 10/2014 |
| CN | 203884699 | | 10/2014 |
| CN | 203952438 | | 11/2014 |
| CN | 203986105 | | 12/2014 |
| CN | 204104836 | | 1/2015 |
| CN | 204104837 | | 1/2015 |
| CN | 204104838 | | 1/2015 |
| CN | 204120239 | | 1/2015 |
| CN | 104397876 | | 3/2015 |
| CN | 204217914 | | 3/2015 |
| CN | 204245158 | | 4/2015 |
| CN | 204273248 | | 4/2015 |
| CN | 204351068 | | 5/2015 |
| CN | 204617067 | | 9/2015 |
| CN | 204653784 | | 9/2015 |

(56) References Cited

FOREIGN PATENT DOCUMENTS

| | | | |
|---|---|---|---|
| CN | 104957773 | | 10/2015 |
| CN | 106455696 | A | 2/2017 |
| EP | 2754361 | A1 | 7/2014 |
| EP | 2989912 | A1 | 3/2016 |
| EP | 3170413 | A1 | 5/2017 |
| EP | 3235390 | A1 | 10/2017 |
| GB | 444944 | | 3/1936 |
| GB | 1271485 | A | 4/1972 |
| GB | 2388040 | | 11/2003 |
| GB | 2515562 | | 12/2014 |
| GB | 2522395 | | 7/2015 |
| GB | 2524779 | A | 10/2015 |
| JP | S59232082 | A | 12/1984 |
| JP | H03105299 | U | 10/1991 |
| JP | 2007136451 | A | 6/2007 |
| JP | 2011518638 | A | 6/2011 |
| KR | 200454619 | Y1 | 7/2011 |
| KR | 20140118985 | A | 10/2014 |
| KR | 20160112770 | A | 9/2016 |
| RU | 2509516 | C2 | 3/2014 |
| RU | 2592163 | C1 | 7/2016 |
| RU | 2597540 | C2 | 9/2016 |
| RU | 2606072 | C2 | 1/2017 |
| RU | 2608277 | C2 | 1/2017 |
| WO | WO2007143993 | | 12/2007 |
| WO | WO2010045408 | | 4/2010 |
| WO | WO2010052323 | | 5/2010 |
| WO | WO2011015850 | | 2/2011 |
| WO | WO2012174677 | | 12/2012 |
| WO | WO2013076750 | | 5/2013 |
| WO | WO2013113173 | | 8/2013 |
| WO | WO-201 3152873 | A1 | 10/2013 |
| WO | WO2014012840 | | 1/2014 |
| WO | WO2014012841 | | 1/2014 |
| WO | WO2014016961 | | 1/2014 |
| WO | WO2014020539 | | 2/2014 |
| WO | WO2014038484 | | 3/2014 |
| WO | WO-201 4115324 | A1 | 7/2014 |
| WO | WO2014110119 | | 7/2014 |
| WO | WO2014110750 | | 7/2014 |
| WO | WO2014139611 | | 9/2014 |
| WO | WO2014140320 | | 9/2014 |
| WO | WO2014187763 | | 11/2014 |
| WO | WO2014195250 | | 12/2014 |
| WO | WO-201 5000974 | A1 | 1/2015 |
| WO | WO2015015431 | | 2/2015 |
| WO | WO2015027470 | | 3/2015 |
| WO | WO2015038981 | | 3/2015 |
| WO | WO2015052192 | | 4/2015 |
| WO | WO-2015079197 | A1 | 6/2015 |
| WO | WO2015079198 | | 6/2015 |
| WO | WO2015109532 | | 7/2015 |
| WO | WO2015124807 | | 8/2015 |
| WO | WO2015127663 | | 9/2015 |
| WO | WO2015139338 | | 9/2015 |
| WO | WO2015149647 | | 10/2015 |
| WO | WO2015165146 | | 11/2015 |
| WO | WO-2015166952 | A1 | 11/2015 |
| WO | WO2015189556 | | 12/2015 |
| WO | WO-201 6014652 | A1 | 1/2016 |
| WO | WO2016009202 | | 1/2016 |
| WO | WO-201 6030661 | A1 | 3/2016 |
| WO | WO-201 6050247 | A1 | 4/2016 |
| WO | WO-201 6054476 | A1 | 4/2016 |
| WO | WO-2016050244 | A1 | 4/2016 |
| WO | WO-201 6075748 | A1 | 5/2016 |
| WO | WO-201 6090426 | A1 | 6/2016 |
| WO | WO-201 7032695 | A1 | 3/2017 |
| WO | WO-2017153591 | A1 | 9/2017 |
| WO | WO-2017185051 | A1 | 10/2017 |
| WO | WO-2018146453 | A1 | 8/2018 |

OTHER PUBLICATIONS

ECIG VAPGO, Mega Twix Dual Tank Clearomizer 3.6 ml, as available at https://www.ecig-vapo.com/mega-twix-dual-tank-clearomizer-36ml-p-911.html, 2 pages.

KIK Dual Tank—Dual Flavour Clearomizer, dated Apr. 13, 2015 and retrieved on Aug. 8, 2019 at http://www.kik.co.uk/kik-dual-tank-dual-flavour-clearomizer, 2 pages.

Prestige Vaping Premium Electronic Cigarettes, Dual Tank Dual Flavour Clearomizer, dated Apr. 19, 2015 and retrieved on Aug. 8, 2019 at http://prestige-vaping.co.uk/dual-tank-clearomizer, 1 page.

Osboo, Dual Tank 240 Clearomizer, dated Dec. 31, 2016 and retrieved on Aug. 8, 2019 at http://www.osboo.co.uk/products/accessories/dual-tank-240-clearomizer/, 1 page.

Craze, Retrieved on Aug. 8, 2019 at http://www.crazeeshisha.com/home, 1 page.

First Union, Dual Tank 240 ISMK Clearomizer, dated May 8, 2015 and retrieved on Aug. 8, 2019 at http://www.chinafirstunion.com/product/Dual-Tank-240.html, 2 pages.

Totally Wicked, Revolver Atomizer Tank, dated Sep. 12, 2015 and retrieved on Aug. 8, 2019 at http://www.totallywicked-eliquid.co.uk/products/replacement-coil-systems-2/replacement-coil-systems/view-all/revolver-atomizer-tank-product.html, 2 pages.

International Search Report and Written Opinion, Application No. PCT/GB2018/050262, dated Apr. 20, 2018, 12 pages.

Communication pursuant to Article 94 (3) EPC for Application No. 18829447.4, dated Oct. 25, 2021, 15 pages.

Communication pursuant to Article 94 (3) EPC for Application No. 18829448.2, dated Oct. 28, 2021, 26 pages.

Decision Grant dated Nov. 27, 2019 for Russian Application No. RU2019125262, 14 pages.

International Preliminary Report on Patentability for Application No. PCT/GB2018/050262, dated Aug. 22, 2019, 7 pages.

International Search Report and Written Opinion for Application No. PCT/GB2018/050266, dated Apr. 20, 2018, 8 pages.

International Preliminary Report on Patentability for Application No. PCT/GB2018/050266, dated May 17, 2019, 12 pages.

International Preliminary Report on Patentability for Application No. PCT/GB2018/053694, dated Mar. 11, 2020, 7 pages.

International Preliminary Report on Patentability for Application No. PCT/GB2018/053696, dated Jul. 2, 2020, 10 pages.

International Search Report and Written Opinion, Application No. PCT/GB2018/053694, dated Mar. 21, 2019, 13 pages.

International Search Report and Written Opinion, Application No. PCT/GB2018/053696, dated Mar. 22, 2019, 17 pages.

Notice of Reason for Refusal for Japanese Application No. 2019-539197 dated Nov. 10, 2020, 8 pages.

Notice of Reasons for Rejection for Japanese Application No. 2020-529273, dated Jun. 8, 2021, 8 pages.

Office Action and Search Report dated Jul. 17, 2019 for Chinese Application No. 201680053577.6, 46 pages.

Office Action For Japanese Application No. 2020-528342, dated Aug. 3, 2021, 13 pages.

Office Action For Korean Application No. 10-2019-7023028, dated Dec. 22, 2020, 15 pages.

Office Action For Korean Application No. 10-2019-7023028, dated Jun. 24, 2021, 3 pages.

Search Report for Russian Application No. 2020120155 dated Nov. 2, 2020, 2 pages.

Search Report for Russian Application No. 2020120336 dated Mar. 2, 2021, 2 pages.

* cited by examiner

VAPOR PROVISION SYSTEM

PRIORITY CLAIM

The present application is a National Phase entry of PCT Application No. PCT/GB2018/050262, filed Jan. 30, 2018, which claims priority from GB Patent Application No. 1702206.2, filed Feb. 10, 2017, which is hereby fully incorporated herein by reference.

FIELD

The present disclosure relates to vapor provision systems such as nicotine delivery systems (e.g. electronic cigarettes and the like), and in particular to providing user notifications in such systems.

BACKGROUND

Electronic vapor provision systems such as electronic cigarettes (e-cigarettes) generally contain a vapor precursor material, such as a reservoir of a source liquid containing a formulation, typically including nicotine and often flavorants, and/or solid material such as a tobacco-based product, from which a vapor is generated for inhalation by a user, for example through heat vaporization. Thus, a vapor provision system will typically comprise a vapor generation chamber containing a vaporizer, e.g. a heating element, arranged to vaporize a portion of precursor material to generate a vapor in the vapor generation chamber. As a user inhales on the device and electrical power is supplied to the vaporizer, air is drawn into the device through inlet holes and into the vapor generation chamber where the air mixes with the vaporized precursor material. There is a flow path connecting the vapor generation chamber with an opening in the mouthpiece so the incoming air drawn through the vapor generation chamber continues along the flow path to the mouthpiece opening, carrying some of the vapor with it, and out through the mouthpiece opening for inhalation by the user.

Vapor provision systems may comprise a modular assembly including both reusable and replaceable cartridge parts. Typically a cartridge part will comprise the consumable vapor precursor material and/or the vaporizer, while a reusable device part will comprise longer-life items, such as a rechargeable battery, device control circuitry, activation sensors and user interface features. The reusable part may also be referred to as a control unit or battery section and replaceable cartridge parts that include both a vaporizer and precursor material may also be referred to as cartomizers.

Cartridges are electrically and mechanically coupled to a control unit for use, for example using a screw thread or bayonet fixing with appropriately engaging electrical contacts. When the vapor precursor material in a cartridge is exhausted, or the user wishes to switch to a different cartridge having a different vapor precursor material, a cartridge may be removed from the control unit and a replacement cartridge attached in its place.

A vapor provision system may be configured to issue user notifications, for example a vapor provision system may comprise a controller configured to monitor an operating state for the system and to determine when a particular operating condition arises and provide a user notification in response thereto. For example, a vapor provision system may be configured to provide a user with a warning when a remaining amount of power/charge in a battery or a remaining amount of vapor precursor material in a cartridge falls below a threshold level. These kinds of user notifications are often provided using an indicator light, such as a light emitting diode, mounted on the device.

The inventors have recognized the known approaches for providing user notifications in vapor provision systems can have some drawbacks. For example, the provision of an indicator light can increase manufacturing complexity and associated costs, and furthermore requires visual attention from users. Accordingly, there is a desire for alternative schemes for providing user notifications in vapor provision systems.

SUMMARY

According to a first aspect of certain embodiments there is provided a vapor provision system configured to selectively generate vapors with different flavor characteristics for inhalation by a user; wherein the system comprises: a first vapor precursor material having a first flavor characteristic; a second vapor precursor material having a second flavor characteristic which is different from the first flavor characteristic; at least one vaporizer for generating vapor from the first vapor precursor material and the second vapor precursor material; and control circuitry configured to control the at least one vaporizer to generate vapor from the first vapor precursor material and the second vapor precursor in a ratio selected to provide vapor with a selected flavor characteristic for normal use; wherein the control circuitry is further configured to determine if a user notification condition arises for the vapor provision system, and in response to determining that a user notification condition has arisen, to control the at least one vaporizer to generate vapor from the first vapor precursor material and the second vapor precursor in a modified ratio to provide vapor with a modified flavor characteristic that is different from the selected flavor characteristic so as to provide a user with an indication the user notification condition has arisen.

According to a further aspect of certain embodiments there is provided vapor provision means for selectively generating vapors with different flavor characteristics for inhalation by a user; comprising: a first vapor precursor material having a first flavor characteristic; a second vapor precursor material having a second flavor characteristic which is different from the first flavor characteristic; vaporizing means for generating vapor from the first vapor precursor material and the second vapor precursor material; and control means for controlling the vaporizing means to generate vapor from the first vapor precursor material and the second vapor precursor in a ratio selected to provide vapor with a selected flavor characteristic for normal use; wherein the control means is further for determining if a user notification condition arises for the vapor provision means, and in response to determining that a user notification condition has arisen, controlling the vaporizing means to generate vapor from the first vapor precursor material and the second vapor precursor in a modified ratio to provide vapor with a modified flavor characteristic that is different from the selected flavor characteristic to provide a user with an indication the user notification condition has arisen.

According to a further aspect of certain embodiments there is provided a method of operating a vapor provision system configured to selectively generate vapors with different flavor characteristics for inhalation by a user by vaporizing different amounts of different vapor precursor materials having different flavor characteristics, wherein the method comprises generating a vapor using a selected ratio of the different vapor precursor materials to generate a vapor with a selected flavor characteristic during normal use, determining that a user notification condition has arisen for the vapor provision system, and in response thereto generating a vapor using a modified ratio of the different vapor precursor materials to generate a vapor with a modified flavor characteristic to provide a user with an indication the user notification condition has arisen.

These and further aspects of certain embodiments are set out in the appended independent and dependent claims. It will be appreciated that features of the dependent claims may be combined with each other and features of the independent claims in combinations other than those explicitly set out in the claims. Furthermore, the approaches described herein are not restricted to specific embodiments such as the examples set out below, but include and contemplate any appropriate combinations of features presented herein. For example, a vapor provision system may be provided in accordance with approaches described herein which includes any one or more of the various features described below as appropriate.

BRIEF DESCRIPTION OF THE DRAWINGS

Embodiments will now be described, by way of example only, with reference to the accompanying drawings, in which.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to vapor provision systems, which may also be referred to as aerosol provision systems, such as e-cigarettes. Throughout the following description the term "e-cigarette" or "electronic cigarette" may sometimes be used; however, it will be appreciated this term may be used interchangeably with vapor provision system and electronic vapor provision system. Furthermore, and as is common in the technical field, the terms "vapor" and "aerosol", and related terms such as "vaporize", "volatilize" and "aerosolize", may also be used interchangeably.

Figure 1:
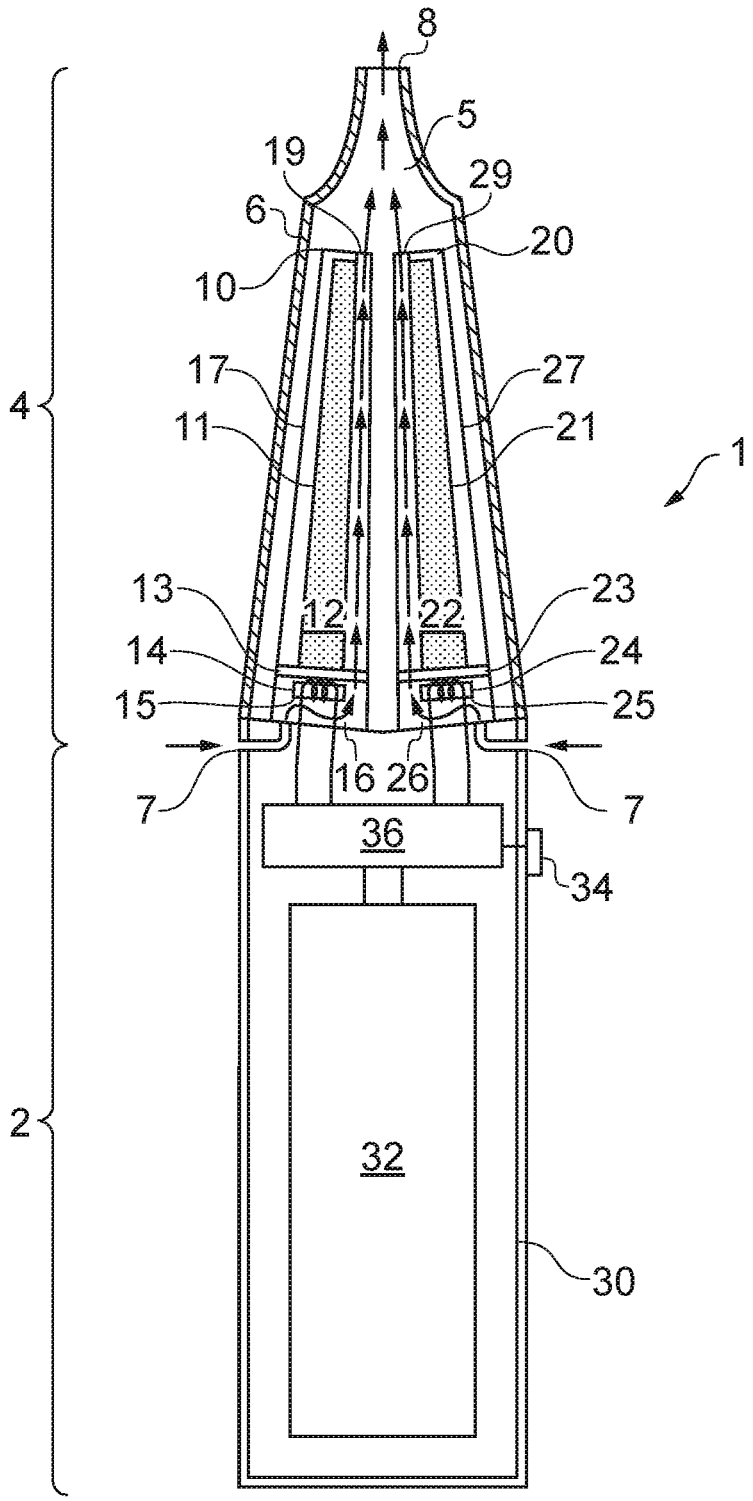
FIG. 1 represents in highly schematic cross-section an aerosol provision system in accordance with certain embodiments of the disclosure.
Figure 2:
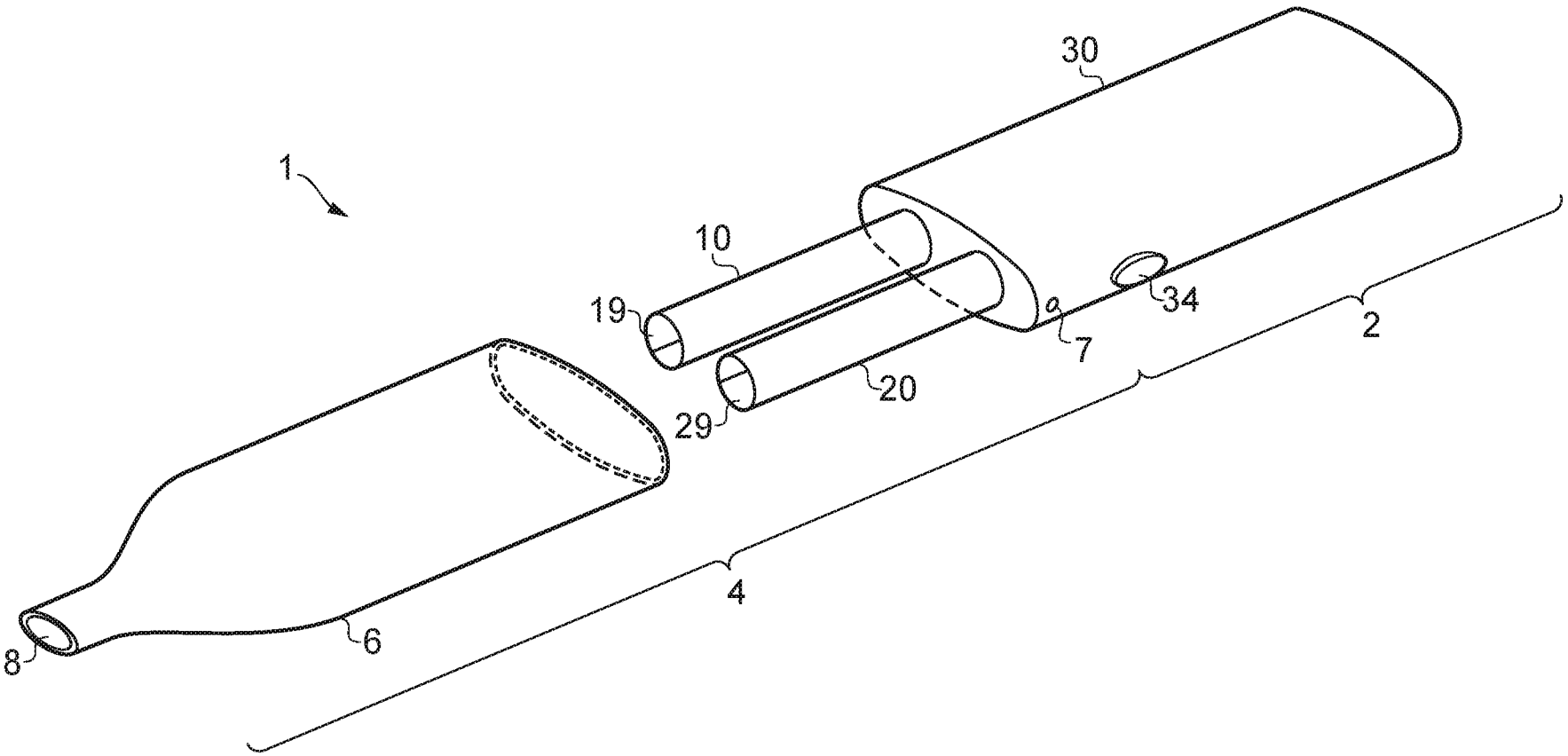
FIG. 2 represents a partially exploded perspective view of the aerosol provision system of FIG. 1.

FIGS. 1 and 2 are respectively schematic cross-sectional and perspective views of an example e-cigarette 1 in accordance with some embodiments of the disclosure. The view of FIG. 2 is partially exploded in showing the e-cigarette 1 with a mouthpiece cover 6 separated from the remainder of the system/device. The e-cigarette 1 may be considered to comprise two main components, namely a control unit 2 and a vapor generation assembly 4. One significant aspect of the electronic cigarette 1 represented in FIG. 1 is that the vapor generation assembly 4 comprises multiple cartridges, in this case two cartridges (other example implementations may comprise more than two cartridges/sources of aerosol precursor material). The control unit 2 is configured to selectively activate vapor generation from one or other or both cartridges, for example in response to user settings, to allow a user to readily choose different flavor characteristics, e.g. type of flavor and/or strength of flavor, for the vapor generated by the electronic cigarette 1.

Thus, the vapor assembly 4 comprises a first cartridge 10 and a second cartridge 20 removably mounted to the control unit 2 in an appropriate manner (e.g. using a conventional bayonet fixing, screw thread or friction-fit fixing). In this example the cartridges are mounted in a generally side-by-side configuration. The mouthpiece cover 6, which is generally hollow, is also removably coupled to the control unit 2, and again this may be in accordance with any conventional coupling/mounting technique. In the cross-sectional representation of FIG. 1 the mouthpiece cover 6 is shown coupled to the control unit 2 for normal use in which it covers the first and second cartridges. In the perspective view of FIG. 2, the mouthpiece cover 6 is shown separated from the control unit 2, for example to provide access to the cartridges 10, 20 to allow them to be replaced. The mouthpiece cover 6 is provided with a tapered end having an opening 8 that defines a vapor outlet through which a user may inhale vapor generated by the electronic cigarette 1 during use. An interior space within the mouthpiece cover 6 between the cartridges 10, 20 and the vapor outlet 8 defines a mixing region 5 in which vapor generated from the two cartridges 10, 20 may be mixed (when both are used simultaneously) for inhalation by a user through the mouthpiece outlet 8 during use.

The first and second cartridges in this example are in essence identical in terms of their structure and operation, but differ in terms of the characteristics of the vapor they produce, that is to say, there are differences in the vapor precursor materials used by the two cartridges. The respective vapor precursor materials may be largely the same (e.g. both cartridges may contain liquids having the same base formulation), but comprise different additives, for example different flavors. In this regard, both cartridges may be associated with different flavors, or one cartridge may be associated with a flavored formulation and another cartridge associated with a non-flavored formulation, or both cartridge may be associated with the same type of flavor, but in different strengths. In this particular example, it is assumed the two different cartridges are associated with two different vapor flavors, for example, the first cartridge 10 may be associated with a menthol flavor and the second cartridge 20 may be associated with a fruit flavor.

In view of the structural similarity between the two cartridges, they are described herein with a focus on the first cartridge 10, it being understood the same description applies for the second cartridge 20.

Thus, the first cartridge 10 comprises a cartridge housing 17, which in this example is formed of a plastics material. The housing 17 supports other components of the cartridge and also provides a mechanical interface with the control unit 2. The manner by which the cartridge 10 mounts to the control unit is not significant to the principles described herein, but for the sake of a concrete example is assumed here to comprise a screw thread fitting (not represented in FIG. 1).

The cartridge housing 17 is generally circularly symmetric about a longitudinal axis with a tapering profile so it reduces in cross section with increasing distance from the end of the cartridge 10 which couples to the control unit 2. In this example the cartridge has a length of around 4 cm and a diameter that tapers down approximately linearly from around 1 cm to 0.7 cm over this length. However, it will be appreciated the specific geometry, and more generally the overall shapes involved, may be significantly different in different implementations.

Within the cartridge housing 17 is a liquid reservoir 11 that contains a vapor precursor material in the form of a source liquid 12. The source liquid may be of a conventional kind used in e-cigarettes, for example comprising an amount of nicotine, e.g. around 3% nicotine, and around 50% glycerol, with the remainder comprising roughly equal measures of water and propylene glycol as well as other components, including in this case a menthol flavoring as discussed above. The liquid reservoir 11 in this example comprises the majority of the interior volume of the cartridge 10. The liquid reservoir 11 generally conforms to the interior of the housing 17 in having a tapering circular cross section, but having a flat face running longitudinally along one side to create a space between an outer wall of the reservoir 11 and an inner wall of the housing 17 to define an air path through the cartridge through which vapor generated in the cartridge is drawn during use towards an opening 19 in the end of the cartridge into the mixing chamber 5 within the mouthpiece cover 6. This air-path through the cartridge is schematically represented by the series of arrows indicating airflow through the vapor provision system 1 during use. The reservoir 11 may be formed in accordance with conventional techniques, for example comprising a molded plastics material.

An end of the reservoir 11 opposite to the cartridge outlet 19 is defined by a porous ceramic disc 13 such that source liquid 12 within the reservoir 11 may seep through the ceramic disc 13.

Adjacent the ceramic disc 13 on the outside of the reservoir 11 is a vaporizer (atomizer) comprising a wick 14 and heater 15. The wick and heater are arranged in a space within the cartridge housing 17 that defines a vaporization chamber 16 for the cartridge 10. Source liquid which has seeped through the ceramic disc 13 may infiltrate the wick 14 through surface tension/capillary action. The heater 15 in this example comprises an electrically resistive wire coiled around the wick 14 so that electrical power may be supplied to the heater 15 to vaporize an amount of source liquid (vapor precursor material) drawn to the vicinity of the heater 15 by the wick 14. In this example the heater 15 comprises a nickel chrome alloy (Cr20Ni80) wire and the wick 14 comprises a glass fiber bundle, but it will be appreciated the specific vaporizer configuration is not significant to the principles described herein.

The rate at which source liquid is vaporized by the vaporizer will depend on the amount of power supplied to the heater 15. Accordingly, electrical power can be applied to the heater to selectively generate vapor from the source liquid 12 in the cartridge 10, and furthermore, the rate of vapor generation can be controlled by adjusting the power supplied to the heater 15, for example through pulse width and/or frequency modulation techniques.

As already mentioned above, the second cartridge 20 has the same overall structure as the first cartridge 10 (indeed the two cartridges are interchangeable in this example). Accordingly, and as for the first cartridge 10, the second cartridge 20 also comprises a cartridge housing 27, a liquid reservoir 21, a cartridge outlet 29, source liquid 22, a ceramic disc 23, a wick 24, a heater 25 and a vaporization chamber 26. These elements of the second cartridge are arranged in the manner described above for the corresponding elements of the first cartridge 10. In other example implementations the different cartridges may have different structures and/or sizes.

The control unit 2 comprises an outer housing 30, a battery 32 for providing operating power for the electronic cigarette, control circuitry 36 for controlling and monitoring the operation of the electronic cigarette and a user input button 34. The battery 32 is rechargeable and may be of a conventional type, for example of the kind normally used in electronic cigarettes and other applications requiring provision of relatively high currents over a relatively short period. Similarly, the user input button 34 may be a conventional input device, for example a mechanical button switch or capacitive (touch) sensor.

The outer housing 30 may be formed, for example, from a plastics or metallic material and in this example has a generally elliptical/oval cross sectional with a width (in the plane of FIG. 1) of around 1.5 to 2 times its thickness (perpendicular to the plane of FIG. 1). For example, the electronic cigarette may have a width of around 3 cm and a thickness of around 2 cm. The mouthpiece cover 6 discussed above has an outer form which generally conforms to the outer form of the control unit 2 where they meet to provide a relatively uniform and smooth appearance for the electronic cigarette 1 as a whole. The end of the mouthpiece cover 6 defining the vapor outlet 8 is tapered down to around one third or so of its dimensions at the end that couples to the control unit 2 (e.g. to around 1 cm wide and 0.6 cm thick). The control unit 2 and mouthpiece cover 6 in this example both have a length of around 5 cm such that the assembled electronic cigarette has a length of around 10 cm. However, and as already noted, it will be appreciated that the overall shape and scale of an electronic cigarette implementing an embodiment of the disclosure is not significant to the principles described herein.

The control circuitry 36 is suitably configured/programmed to provide functionality in accordance with embodiments of the disclosure as described herein, as well as for providing conventional operating functions of the electronic cigarette in line with the established techniques for controlling such devices. Thus the control circuitry may be considered to logically comprise a number of different functional blocks, for example a functional block for controlling the supply of power from the battery 32 to the heater 15 in the first cartridge 10, a functional block for controlling the supply of power from the battery 32 to the heater 25 in the second cartridge 20, a functional block for controlling operational aspects of the device in response to user input using the input button 34, for example configuration settings, as well as other functional blocks associated with the normal operation of electronic cigarettes and functionality in accordance with the principles described herein. It will be appreciated that the functionality of these logical blocks may be provided in various different ways, for example using a single suitably programmed general purpose computer, or suitably configured application-specific integrated circuit(s)/circuitry. As will be appreciated the electronic cigarette will in general comprise various other elements associated with its operating functionality, for example a port for charging the battery, such as a USB port, and these may be conventional and are not shown in the figures or discussed in detail in the interests of brevity.

The control circuitry 36 is configured to control the supply of electrical power from the battery 32 to the heaters 15, 25 in the respective cartridges 10, 12 so as to selectively generate a vapor from one or other or both cartridges for inhalation by a user. Electrical power is supplied to the respective heaters via contacts established across the interface between the respective cartridges 10, 20 and the controller unit 2, for example through sprung/pogo pin connectors, or any other configuration of electrical contacts which engage when the cartridges 10, 20 are connected to the control unit 2.

A user may select the relative amounts of vapor generated by each of the cartridges 10, 20 during use. This may be configured, for example, through a configuration menu for the device, which may be accessed through the user input button 34. For example a user may press the button 34 in a predefined sequence to enter a programming mode, and then press the button in a further predefined sequence to set desired vapor generation levels for respective ones of the cartridges. The user may be able to freely set the relative amounts of vapor (i.e. level of power supplied) for each cartridge, or may select from a predefined number of settings depending on the implementation at hand. In other examples there may be other means for setting the relative levels of vaporization from the two cartridges, for example the device may comprise additional user inputs, for example one or more additional buttons/dials/sliders for this purpose, or the device may support remote programming using an ancillary device arranged to exchange data with the electronic cigarette 1, for example a computing device, such as a smartphone, running an appropriate application. In some cases the relative levels of vaporization may not be defined in advance of a given puff, but may be selected in real-time during use, for example by having a separate activation button associated with each of the cartridges which may be independently activated by a user, for example on a puff-by-puff basis. Thus, a user may press one button to select one flavor and press another button to select another flavor, or may press both buttons for a mixed flavor. This type of separate control for each cartridge may also allow for variable power settings for each cartridge in accordance with conventional techniques. In yet other examples the relative amounts of vaporization provided by the respective cartridges may be fixed for normal use (i.e. factory set rather than user set).

Regardless of how the relative amounts of vapor to be delivered by the respective cartridges (i.e. the relative amount of power to be delivered to the heaters in the respective cartridges) is configured, when the electronic cigarette is in its normal operating mode, a user may press the button 34 to activate the respective heaters 15, 25 in the respective cartridges 10, 20 in accordance with the configured relative power settings. For example, if the control circuitry 36 is configured to supply an equal amount of electrical power to the respective heaters 15, 25 in the respective cartridges 10, 20 in response to a user pressing the input button 34, comparable amounts of vapor will be generated by each of the cartridges 10, 20, thereby providing a user with a vapor comprising a roughly 50:50 mix of the flavors provided by the cartridges. Conversely, if the control circuitry 36 is configured to supply twice as much power to the first cartridge (menthol flavored) compared to the second cartridge (fruit flavored), the resulting vapor will have a stronger menthol flavor. Likewise, if the control circuitry is configured to supply twice as much power to the second cartridge (fruit flavored) compared to the first cartridge (menthol flavored), the resulting flavor will have a relatively stronger fruit flavor. In any given application, the relative amounts of power supplied to the respective cartridges may be continuously variable, or may be quantized. For example, at one extreme the device may be configured during normal use to provide only vapor from one cartridge or only vapor from the other cartridge, with no mixing. That is to say, the user may be provided with the opportunity to selectively power the heater in the first cartridge to provide a menthol-flavored vapor or to selectively power the heater in the second cartridge to provide a fruit-flavored vapor, but the electronic cigarette 1 might be configured to not allow power to be supplied to both heaters simultaneously.

Accordingly, when a user presses the user input button 34 the vapor generation function of the electronic cigarette 1 is activated—i.e. electrical power is supplied to one or other or both of the heaters 15, 25 in accordance with a desired configuration. Although in this example a user input button 34 is used to trigger vapor generation, it will be appreciated that the activation of vapor generation function may be based on other techniques. For example, instead of using a button to activate the supply of power to the heaters, an inhalation sensor, for example based around a pressure sensor/microphone arranged to detect a drop in pressure when a user inhales on the device, may be used.

When the vapor generation function of the electronic cigarette 1 is activated, a user sucks/inhales on the mouthpiece outlet 8 of the mouthpiece cover 6 to draw air through the electronic cigarette. The flow of air through the electronic cigarette is schematically indicated in FIG. 1 by a series of arrows. Thus, air is drawn from the environment into the electronic cigarette 1 through one or more air inlets 7, which in this case are provided in the control unit 2. A portion of the air drawn into the electronic cigarette 1 is drawn along an inlet air path to enter the vaporization chamber 16 in the first cartridge 10 and a portion of the air drawn into the electronic cigarette 1 is drawn along an inlet path to enter the vaporization chamber 26 of the second cartridge 20. Accordingly, the incoming air flows past the respective heaters 15, 25 in the respective vaporization chambers 16, 26 while one or both of the heaters is receiving electrical power from the battery in the control unit 2 so as to generate a vapor from the relevant source liquid(s)/vapor precursor material(s) in the corresponding vaporization chamber(s). The vaporized liquid is then incorporated/entrained into the airflow and drawn through the relevant cartridge (along the air path defined by the gap between the flat of the reservoir and the outer housing discussed above) to exit the relevant cartridge through its opening 19, 29 and into the mixing chamber 5, from where it is drawn out of the mouthpiece opening 8 for inhalation by a user.

Thus, the electronic cigarette 1 can be used to selectively generate vapor from one or other or both of the different source liquids 12, 22 stored in the respective cartridges 10, 20. This provides a user with increased choice, for example in terms of which flavor (s) they would like to taste at any given time.

During normal use the control circuitry 36 is configured to monitor various operational aspects of the electronic cigarette. For example, the control circuitry may be configured to estimate a remaining amount of source liquid in each of the cartridges, for example based on an accumulated time of usage since a new cartridge was installed, or based on sensing the liquid levels in the cartridge, and this may be performed in accordance with any conventional techniques. The control circuitry may also be configured to monitor a level of power remaining in the rechargeable battery 32, and again this may be performed in accordance with conventional techniques. If it is determined through monitoring the operational aspects of the electronic cigarette that a certain operating condition has arisen, for example a cartridge is approaching depletion, or a battery level is falling below a predefined threshold (which may be predefined or user set), the electronic cigarette is configured to provide a user notification, and in accordance with certain embodiments of the disclosure, the user notification is provided by the control circuitry causing a change in the relative amounts of vaporization generated within the two cartridges. For example, if a user has selected a 50:50 mix of vapor from the two cartridges (i.e. equal amount of power supplied to the respective heaters) during normal use, in response to determining a low battery condition, the control circuitry may be configured to change the relative amounts of vaporization occurring within the two cartridges, for example by increasing the amount of power supplied to one cartridge compared to the other, thereby modifying the overall flavor provided by the electronic cigarette, which is sensed by the user and interpreted as a user notification. The change in flavor may be applied for a predetermined period, for example the duration of a single puff or a number of puffs, or a fixed period of time, which might be within a single puff or span multiple puffs. After the predetermined period during which the modified/user notification flavor is generated, the flavor may revert to the selected flavor for continued normal use. In this case the control circuitry may be further configured to issue a second user notification, for example by changing flavor again, if the user notification condition persists for more than a predefined period of time. For example, if the user fails to recharge the battery within an hour of an initial user notification relating to a low battery level condition, the control circuitry may issue another notification by changing flavor again. A second notification for a given user notification condition may be the same as an initial notification, or may be different, for example, a second notification may persist for a longer period of time than a first notification. In other cases the delivery of a modified flavor may persist for as long as the user notification condition remains and/or until a user provides an indication the user notification has been acknowledged, for example by pressing the button in a predefined combination to in effect clear the user notification.

Thus, in accordance with certain embodiments, an electronic cigarette is configured to provide a user with feedback by changing a flavor of vapor provided by the electronic cigarette rather than changing the status of a light indicator. Not only does this obviate the need for a separate status light indicator, it can provide a user with appropriate feedback/user notification, without the user needing to maintain visual focus on a light indicator. This can help reduce the risk of a user not realizing a user notification has arisen, and can also help provide a user with notifications in situations where an illuminating light would not be desired, for example in a cinema or theatre.

In addition to providing a user notification in response to low levels of source liquid or remaining battery power, it will be appreciated there are many other situations in which a user notification might be desired. For example, a user may in effect wish to set an alarm, for example to remind them to do something, by configuring their electronic cigarette to switch flavor at a given time, for example a specific time of day or after a certain time has elapsed from when the notification was configured (i.e. a "countdown timer" alarm).

The electronic cigarette may also be configured to provide a user notification by changing flavor based on a determined amount of use. For example, an electronic cigarette may be configured to generate a different flavor after a given amount of vapor has been generated in a given time period, example based on a number of puffs or integrated time of use in a given time window, to help a user track the rate at which they are using the electronic cigarette. For example, a user may configure the device to alert them through flavor change when they have inhaled an amount of vapor comprising an amount of nicotine corresponding to that typically provided by a conventional cigarette, for example based on an integrated amount of power supplied to the heaters or count of the number of puffs since the last occurrence of the flavor change user notification.

Figure 3:
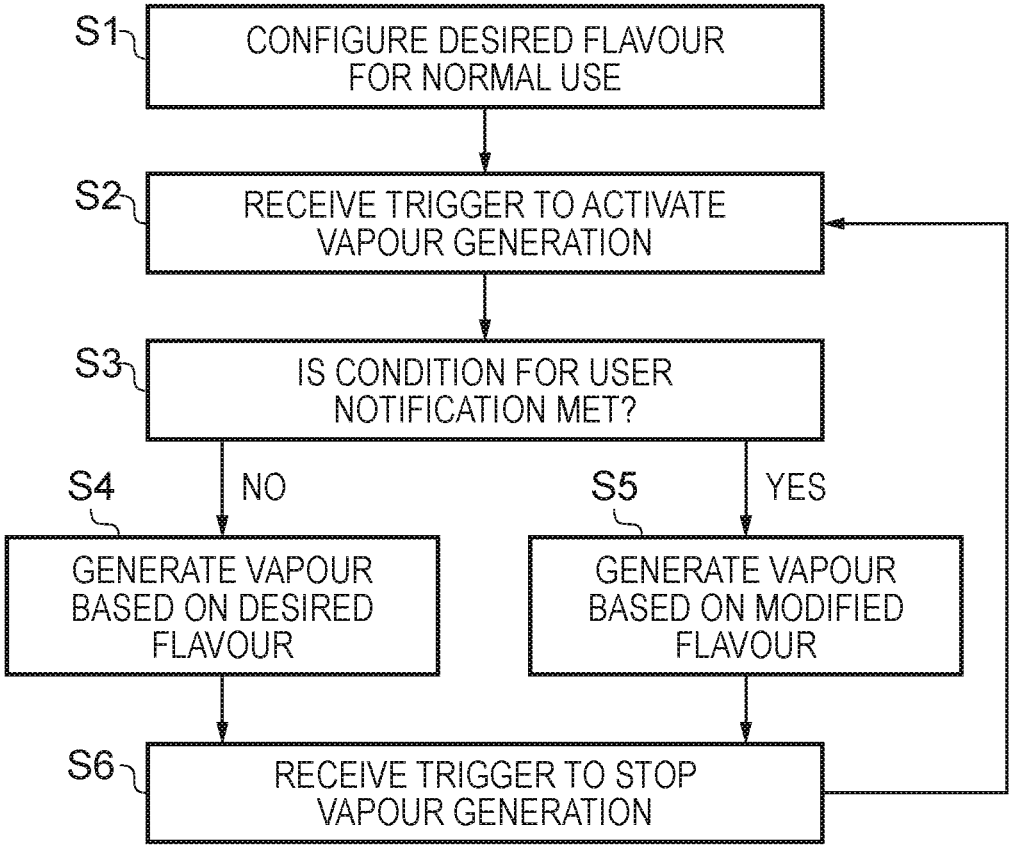
FIG. 3 is a flow diagram schematically representing a method of operating the aerosol provision system of FIGS. 1 and 2 in accordance with certain embodiments of the disclosure.

FIG. 3 is a flow chart schematically representing some operations for the vapor provision system 1 represented in FIGS. 1 and 2 in accordance with an embodiment of the present disclosure. The control circuitry 36 is configured to implement this processing in accordance with conventional programming/processing techniques.

In S1 the electronic cigarette 1 is configured to deliver a desired flavor during normal use. As discussed above, this may involve the user setting relative amounts of vapor from each of the cartridges in accordance with a personal preference, for example by programming the device using the input button 34, or other means. The electronic cigarette 1 may be configured to allow the user to reconfigure the desired flavor for normal use as and when desired, for example it might be set to apply until to one or both cartridges is exchanged, it may be configured to apply for a single use session (i.e. from switch on to switch off), or it may be configured on a puff-by-puff basis. More generally, the desired ratio of flavors may be configured to apply until a new configuration is set. For the sake of a concrete example, it is assumed here the user configures the electronic cigarette to generate an equal mix of vapor from each cartridge (i.e. a 50:50 mix of menthol-to-fruit flavoring). Thus, the electronic cigarette is configured to nominally supply the same amount of power to the respective heaters 15, 25 in the two cartridges 10, 20 during normal use.

In S2 the control circuitry 36 receives an indication (trigger) that the vapor generation function of the electronic cigarette should be activated. This trigger indication may, for example, correspond with a detection that the user has pressed the user input button 34 while the device is in a normal operating mode. Alternatively, and depending on implementation, S2 may be based on the detection of a different type of trigger to activate vapor generation, for example a pressure sensor-based detection indicating that a user has started to inhale on the device may be used to provide what is in effect an automatic trigger to start vapor generation (i.e. supply power to the heaters). This may be performed in accordance with conventional techniques for detecting when to activate vapor generation in a vapor delivery system such as an electronic cigarette.

In S3, the control circuitry 36 determines whether or not any of one or more predefined conditions for user notification has been met. As noted above, the condition for user notification may relate to an operating state of the electronic cigarette which is being monitored by the control circuitry. For example the condition for user notification may correspond with a determination that a cartridge is approaching depletion or that the remaining energy in the battery has dropped below a threshold amount. A user notification condition may be based on user settings, for example a time-based alarm or an indication the device has been used for more than a set amount since a given time (e.g. for a defined number of puffs or integrated duration of vapor generation since the aerosol provision system was last switched on). More generally, the determination of whether a predefined condition for user notification has been met may in some examples be based on established techniques for determining when an electronic cigarette should provide a user notification.

If in S3 it is determined that a condition for user notification is not met, the processing represented in FIG. 3 follows the branch marked "NO" from S3 to S4.

In S4, the control circuitry drives the heaters in the respective cartridges in accordance with the desired flavor for normal use configured in S1. For example, in this particular case where it is assumed the user has configured the device to provide an equal mix of vapor from the two cartridges for normal use, the control circuitry is configured to supply an equal amount of power to the two cartridges in S4. It will be appreciated that the ratio of power provided to the respective cartridges in S4 will depend on the desired flavor configuration established in S1. Thus, in step S4 the user is provided with vapor in accordance with the desired flavor configuration established in step S1. This is the normal operation/use of the electronic cigarette and will not be interpreted by the user as providing any indication of a condition for user notification having arisen.

In S6, while generating vapor based on the desired flavor discussed above in relation to S4, the control circuitry 36 receives an indication (trigger) that the vapor generation function of the electronic cigarette should be stopped. This trigger indication may, for example, correspond with a detection that the user has released the user input button 34. Alternatively, and depending on implementation, S6 may be based on the detection of a different type of trigger to stop vapor generation, for example a pressure sensor-based detection that a user has stopped inhaling on the device may be used to provide what is in effect an automatic trigger to stop vapor generation. This step may be performed in accordance with conventional techniques for detecting when to stop vapor generation in a vapor delivery system such as an electronic cigarette. In response to the trigger to stop vapor generation being received in S6, the control circuitry cuts the supply of electrical power to the respective heaters 15, 25 in the respective cartridges 10, 20. This represents the end of a puff on the device.

When a puff has been completed, the user may switch off the electronic cigarette, in which case the processing represented in FIG. 3 is brought to a halt. Alternatively, the electronic cigarette may be retained in a standby mode awaiting the user's next puff, which begins when the control circuitry receives another trigger to activate vapor generation, as schematically indicated in FIG. 3 by the flow path from S6 back to S2, from where processing continues.

Accordingly, the processing represented in S1, S2, S3, S4 and S6 of FIG. 3 in effect represents a normal mode of operation for a multi-cartridge electronic cigarette in accordance with embodiments of the disclosure in which a vapor having a predefined flavor combination is provided to a user.

Returning now to S3, if it is determined in this step that one or more predefined conditions for user notification is met, the processing represented in FIG. 3 follows the branch marked "YES" from S3 to S5. As already noted, there are various conditions that may be considered to give rise to a desire for user notification, and these will depend on the implementation at hand. It will, of course, be appreciated that the exact nature of the condition giving rise to the user notification in any given case is not significant to the general manner in which the user notification is provided in accordance with the principles described herein, i.e. by providing a flavor feedback cue. For the sake of a concrete example, it will be assumed here that the condition for user notification being met in S3 corresponds with a determination the present battery level is less than a predefined threshold amount, for example less than 10 percent of its fully-charged capacity.

In S5, having followed the branch marked "YES" from S3 in response to the control circuitry determining a condition for user notification has been met (i.e. low battery in this example), the control circuitry is configured to drive the heaters in the respective cartridges to provide a flavor which is different from the desired flavor for normal use established in S1. For example, in this particular case where it is assumed the user has configured the device to provide an equal mix of vapor from the two cartridges in normal use, the control circuitry is configured in S5 to instead supply only one of the two flavors by only supplying power to a corresponding one of the cartridges in S5. For example, the control circuitry may be configured to only supply power to the second cartridge (fruit flavor), thereby resulting in the generation of a vapor which is fruit flavored, but does not contain menthol flavoring (or at least contains a much reduced amount of menthol flavoring, it being understood the user may be able to detect some residual menthol flavoring from previous usage). It will, of course, be appreciated that the ratio of power provided to the respective cartridges in S5 will depend on the nature of the modified flavor (i.e. the flavor that is different from that established in S1) that is to be provided by way of a user notification. Accordingly, in S5 the user is provided with vapor having a flavor of which is different from the desired/selected flavor configuration established in S1. This will be noticed by the user and interpreted by the user as an indication that a condition has arisen requiring user attention in much the same way as a user may interpret an indicator light provided for user notification in a conventional electronic cigarette.

It will be appreciated that the specific flavor provided in S5 (i.e. the specific amounts of power applied to the respective heaters to generate the modified flavor) may be dependent on the selected flavor established in S1 so as to provide as different a flavor as possible to that expected by the user. For example, if in S1 the electronic cigarette is configured to provide a flavor that does not correspond to a 50:50 mix (i.e. nominally equal power supplied to each heater in normal use), but instead has more of one flavor than another, i.e. so that the mixture comprises a major flavor and a minor flavor, the modified flavor provided in S5 may correspond with only providing power to the cartridge containing the minor flavor aerosol precursor material. This can help provide the greatest contrast between the desired flavor for normal use configured in S1, and the modified flavor used in S5 to provide a user notification.

It will also be appreciated that different flavors may be used to indicate different user notifications. For example, vapor generation using only one of the cartridges (e.g. fruit flavor without menthol flavor) may indicate low battery voltage, whilst vapor generation using only the other of the cartridges (e.g. menthol flavor without fruit flavor) may indicate a different user notification condition, for example that one of the cartridges is almost depleted. It will be appreciated that this approach could in certain circumstances give rise to uncertainty, for example if a user is allowed to select vapor generation from only one of the cartridges for normal use, exclusive use of a given flavor cannot be reliably used to indicate a user notification. However in this case a different flavor combination can be used, for example a mix of flavors may indicate one user notification condition while another mix of flavors may indicate another notification condition. In other examples where it is desired to use different flavors to distinguish between different types of user notification, the control circuitry for the e-cigarette may be configured to cause the electronic cigarette to initially provide a common flavor to indicate a condition for user notification has arisen, the common flavor being chosen to contrast with the desired flavor established in S1, and then after a period of time, for example two seconds of providing this contrasting flavor, or in a subsequent puff, the control circuitry may be configured to provide a different flavor which indicates a particular user notification condition in accordance with a predefined mapping. That is to say, the user is first alerted that there is a user notification by noting there is a change in flavor delivered by the vapor provision system from that which the user is expecting, and the user is then subsequently alerted to the nature of the user notification as the flavor changes to a different flavor depending on the nature of the user notification.

For example, in a first step, the control circuitry may be configured to provide a contrast in flavor that takes account of the currently selected flavor in the manner described above, and then, in a second step, the control circuitry may be configured to provide a burst of flavor exclusively from one or other cartridge to indicate that a particular cartridge is approaching depletion, and to provide a burst of mixed flavor to indicate the battery voltage is low. Of course it will be appreciated that a specific mapping between different flavors/flavor combinations which may be provided by the vapor provision system and different user notifications may be selected according to any desired scheme.

It will be further appreciated once a user is provided with a user notification by virtue of the flavor of the aerosol generated by the aerosol provision system differing from a current configuration, the user may be provided with more details on the cause of the notification by other means. For example, in a device that does include an indicator light, the user may, on receiving a flavor-based indication of a user notification, press a button on the device to cause the light to provide more details on the nature of the user notification (e.g. through a choice of color or flashing pattern).

It will further be appreciated that in other implementations, the user might not be provided with any indication of the nature of the user notification, but only that a user notification has arisen. The user may then determine the nature of the notification, for example by examining the contents of the cartridges to see if they are nearly depleted or observing a battery level indicator provided on the electronic device to check if the battery is approaching a state in which it needs to be recharged.

The vapor generation in S5 may continue for a predetermined period of time, e.g. two seconds, but in this example it is assumed to carry on until a trigger to stop vapor generation is received in S6 in the manner described above following normal use vapor generation in S4, at which point the electronic vapor provision system may proceed in the manner discussed above.

Thus, in accordance with the principles described herein, a vapor provision system may be configured to provide user feedback through the delivery of modified flavors.

While some particular examples have been described above, it will be appreciated that there are many modifications that could be made in accordance with other implementations.

For example, in the implementation represented in FIGS. 1 and 2, each of the cartridges comprises its own vaporizer. That is to say, there is a separate vaporizer associated with each of the vapor precursor materials. In this case the control circuitry 36 may generate a vapor from a selected ratio of the first source liquid 12 and the second source liquid 22 by applying an appropriate amount of power to the heaters of the respective vaporizers. This results in the generation of initially separate vapors from each of the different source liquids, with these vapors then being combined/mixed in the mixing chamber 5 before inhalation by a user. That is to say, in this example implementation, the vapors are mixed in the desired ratio after generation. However, in other examples a first source liquid and a second source liquid may be mixed in a desired ratio prior to vaporization, for example by delivering the first source liquid and the second source liquid to a single vaporizer at relative rates corresponding to a desired ratio. In such a case, the single vaporizer may, for example, be provided within a control unit part of a vapor provision system. The different source liquids may be delivered to the vaporizer at the desired rates/in the desired ratio using appropriately controlled pumps or valves. For example, if a user indicates a desire to use twice as much of a first source liquid than a second source liquid to generate a vapor, the control circuitry may be configured to pump liquid from a reservoir for the first source liquid at a rate which is twice the rate at which liquid is pumped from a reservoir for the second liquid.

Figure 4:
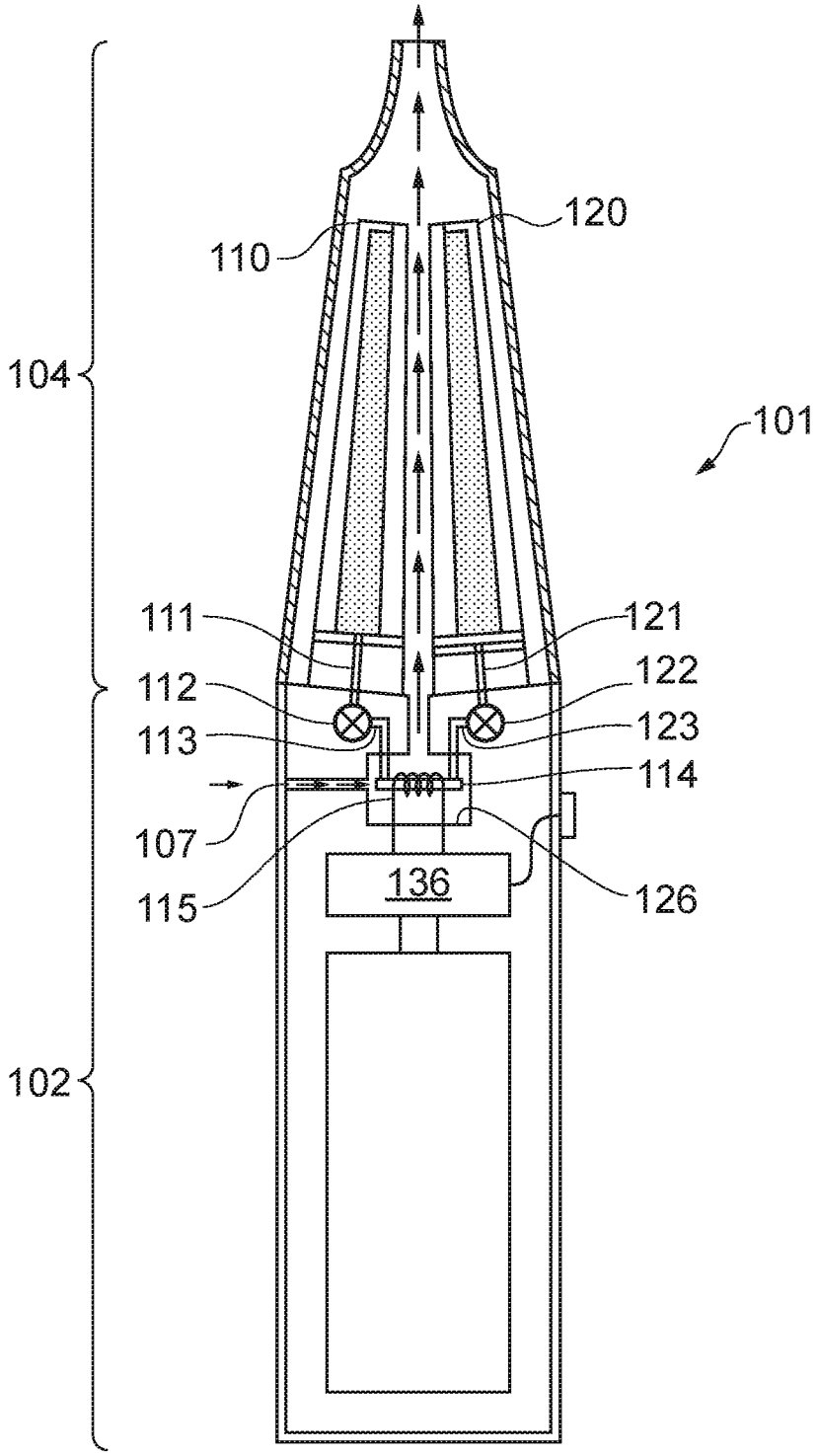
FIG. 4 represents in highly schematic cross-section an aerosol provision system in accordance with certain other embodiments of the disclosure.

FIG. 4 is a schematic cross-section of a vapor provision system 101 according to certain embodiments of the disclosure that uses a single vaporizer. Many aspects of the system 101 represented in FIG. 4 are similar to, and will be understood from, corresponding aspects of the system 1 represented in FIG. 1, and these are not described again in the interest of brevity. The system of FIG. 4 again comprises a vapor generation assembly 104 including a first source liquid cartridge 110 and a second source liquid cartridge 120 and a control unit part 102 comprising control circuitry 136 (and other elements such as discussed above). However, the system 101 of FIG. 4 differs from the system 1 of FIG. 1 in having a single vaporizer comprising a wick 114 and a heater 115, rather than separate vaporizers in each cartridge. This single vaporizer may be based on the same principles as described above for the separate vaporizers in each of the cartridges, or indeed may be based on any vaporization technology. In the example of FIG. 4, the single vaporizer is mounted in the control unit 102 part of the system 101. The first cartridge 110 and second cartridge 120 contain respective source liquids, which may be the same as discussed above for the system 1 represented in FIG. 1. However, the respective cartridges do not comprise a vaporizer and ceramic disc, but instead each comprise a fluid path 111, 121 providing fluid communication between their respective reservoirs of source liquid and the controller unit 102.

When the respective cartridges 110, 120 are coupled to the control unit 102, their respective fluid paths 111, 121 align with corresponding fluid paths 113, 123 in the control unit 102. The fluid paths 113, 123 in the control unit each comprise a micro fluid pump 112, 122, which may be based on any known technology, and provide for pumped fluid communication between the fluid paths 111, 121 in the cartridges and the wick element 114 of the vaporizer in the control unit 102.

The control circuitry 136 is configured to control the respective fluid pumps 112, 122 to deliver liquid from the respective cartridges to the wick 114 of the vaporizer via the respective fluid paths 111, 113, 121, 123. The control circuitry 136 is also configured to drive the heater 115 of the vaporizer in the control unit 102 to generate vapor from the combination of liquid delivered to the wick 114 by the respective pumps 112, 122. The vapor is generated in a vapor generation chamber 126 so that when a user draws on the mouthpiece end of the system 101, air is drawn in through an inlet 107 in the control unit 102, into the vapor generation chamber 126 where it mixes with the vaporized mixture/combination of source liquids and is drawn out through the mouthpiece of the system as schematically indicated by the arrows in FIG. 4.

The control circuitry 136 can configure the pumping rates of the respective pumps 112, 122 so as to deliver source liquid for vaporization from the respective cartridges in a desired/selected combination in much same way as the control circuitry 36 of the example implementations discussed above can control the relative amounts of power delivered to the respective vaporizers in the respective cartridges in that example. Thus, the relative rates of fluid delivery to the vaporizer may be modified in response to a user notification condition arising so as to modify a flavor characteristic associated with the resulting vapor.

More generally, it will be appreciated the specific manner in which the vapor is generated, both in terms of the underlying vapor generation technology, and whether the source liquid is in effect mixed/combined before or after vaporization is not significant to the underlying principle of providing user feedback, and in particular an indication of the occurrence of an event for which it is desired to notify the user, by changing the flavor of a vapor generated by a vapor provision system.

Thus it will be appreciated that whereas the above-described embodiments have primarily focused on an electrical heater based vaporizer for heating a source liquid, the same flavor modification principles may be adopted in accordance with vaporizers based on other technologies, for example piezoelectric vibrator based vaporizers, and devices based on other aerosol precursor materials, for example solid materials, such as plant derived materials, such as tobacco derivative materials.

It will also be appreciated that while the above-described examples have focused on implementations comprising two source liquids, in other implementations, the same principles may be applied in respect of vapor provision systems comprising more than two source liquids. For example, a vapor provision system in accordance with some implementations may comprise three, four or more different vapor precursor materials to provide for a wider range of flavor characteristics.

It will also be appreciated that the specific nature of the flavors used in accordance with different implementations is not significant. For example, the actual flavors of the different source liquid are not significant. Furthermore, in some implementations the different source liquids may have the same flavor, but at different strengths/levels. In yet other implementations, one of the liquids may be flavored, and the other liquid may not be flavored. More generally, what is significant is that a characteristic of the flavor associated with a vapor generated by an aerosol provision system can be adjusted/modified to provide user feedback based on taste and/or smell. Thus a change in flavor characteristic to indicate a user notification event/condition has arisen may comprise, for example, (i) a change in an actual flavor (e.g. from a mixture of menthol and fruit to pure menthol), (ii) a change in a strength of a flavor (e.g. from a relatively weak menthol flavor to a relatively strong menthol flavored), or (iii) a change in whether there is any flavor (e.g. from no flavor to menthol flavor or vice versa).

Thus, there has been described a vapor provision system configured to selectively generate differently-flavored vapors for inhalation by a user and to make use of this ability to provide user feedback. The system comprises a first vapor precursor material having a first flavor and a second vapor precursor material having a second, different, flavor. The system includes one or more vaporizers arranged to generate vapor from a selectable ratio of the first and second vapor precursor materials to provide a vapor with a selectable flavor for normal use. The system further comprises control circuitry configured to determine if a user notification condition arises for the vapor provision system, such as a low battery warning, and in response to determining a user notification condition has arisen, to control the at least one vaporizer to generate a vapor using a modified ratio of the first and second vapor precursor materials to provide a vapor with a different flavor by way of an indication that a user notification condition has arisen.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention (s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. A vapor provision system configured to selectively generate vapors with different flavor characteristics for inhalation by a user, the system comprising:

a first vapor precursor material having a first flavor characteristic;

a second vapor precursor material having a second flavor characteristic which is different from the first flavor characteristic;

at least one vaporizer for generating vapor from the first vapor precursor material and the second vapor precursor material; and control circuitry configured to control the at least one vaporizer to generate vapor from the first vapor precursor material and the second vapor precursor in a ratio selected to provide vapor with a selected flavor characteristic for normal use, wherein the control circuitry is further configured to determine if a user notification condition arises for the vapor provision system, and in response to determining that the user notification condition has arisen, to control the at least one vaporizer to generate vapor from the first vapor precursor material and the second vapor precursor in a modified ratio to provide vapor with a modified flavor characteristic that is different from the selected flavor characteristic so as to provide a user with an indication the user notification condition has arisen.

2. The vapor provision system of claim 1, wherein the at least one vaporizer comprises a first vaporizer for generating vapor from the first vapor precursor material and a second vaporizer for generating vapor from the second vapor precursor material.

3. The vapor provision system of claim 1, wherein the at least one vaporizer comprises a single vaporizer for generating vapor from both the first vapor precursor material and the second vapor precursor material.

4. The vapor provision system of claim 1, wherein the user notification condition corresponds with an operating characteristic of the vapor provision system being determined to match a predefined state.

5. The vapor provision system of claim 4, wherein the operating characteristic of the vapor provision system is an estimated amount of one of the first vapor precursor material or the second vapor precursor material remaining in the vapor provision system, and the user notification condition corresponds with the estimated amount of the one of the first vapor precursor material or the second vapor precursor material remaining in the vapor provision system being determined to have reached or fallen below a predefined threshold amount of vapor precursor material.

6. The vapor provision system of claim 4, wherein the operating characteristic of the vapor provision system is an estimated charge remaining in a cell providing electrical power for the vapor provision system, and the user notification condition corresponds with the estimated charge remaining in the vapor provision system being determined to have reached or fallen below a predefined threshold amount of charge.

7. The vapor provision system of claim 4, wherein the vapor provision system comprises a clock and the operating characteristic of the vapor provision system is a clock time, and the user notification condition corresponds with the clock time matching a user-specified time.

8. The vapor provision system of claim 4, wherein the operating characteristic of the vapor provision system is an estimated amount of vapor generated during a defined period of use, and the user notification condition corresponds with the estimated amount of vapor generated during the defined period of use reaching or exceeding a predefined threshold amount of vapor generation.

9. The vapor provision system of claim 4, wherein the predefined state for triggering a user notification is user-defined.

10. The vapor provision system of claim 1, wherein the control circuitry is configured to determine the modified ratio for providing a user with an indication the user notification condition has arisen in a manner that takes account of the selected ratio for normal use.

11. The vapor provision system of claim 1, wherein the modified ratio for generating vapor with a modified flavor characteristic corresponds with using one of the first vapor precursor material or the second vapor precursor material to generate vapor while using none of the other of the first vapor precursor material or the second vapor precursor material to generate vapor.

12. The vapor provision system of claim 1, wherein the control circuitry is further configured to determine if a further user notification condition arises for the vapor provision system, and in response to determining that the further user notification condition has arisen, to control the at least one vaporizer to generate vapor from the first vapor precursor material and the second vapor precursor material in a further modified ratio to provide vapor with a further modified flavor characteristic that is different from the selected flavor characteristic to provide a user with an indication the further user notification condition has arisen.

13. The vapor provision system of claim 12, wherein the further modified flavor characteristic is different from the modified flavor characteristic.

14. The vapor provision system of claim 1, wherein the control circuitry is configured to determine the modified ratio for providing a user with an indication the user notification condition has arisen in a manner that takes account of a nature of the user notification condition.

15. The vapor provision system of claim 1, wherein the system is a modular system comprising a control unit, a first replaceable cartridge and a second replaceable cartridge, wherein the control unit comprises the control circuitry, the first cartridge comprises the first vapor precursor material, and the second cartridge comprises the second vapor precursor material.

16. The vapor provision system of claim 1, wherein at least one of the first vapor precursor material or the second vapor precursor material comprises a liquid formulation.

17. Vapor provision means for selectively generating vapors with different flavor characteristics for inhalation by a user, comprising:

a first vapor precursor material having a first flavor characteristic;

a second vapor precursor material having a second flavor characteristic which is different from the first flavor characteristic;

vaporizing means for generating vapor from the first vapor precursor material and the second vapor precursor material; and control means for controlling the vaporizing means to generate vapor from the first vapor precursor material and the second vapor precursor in a ratio selected to provide vapor with a selected flavor characteristic for normal use, wherein the control means is further for determining if a user notification condition arises for the vapor provision means, and in response to determining that the user notification condition has arisen, controlling the vaporizing means to generate vapor from the first vapor precursor material and the second vapor precursor in a modified ratio to provide vapor with a modified flavor characteristic that is different from the selected flavor characteristic to provide a user with an indication the user notification condition has arisen.

18. A method of operating a vapor provision system configured to selectively generate vapors with different flavor characteristics for inhalation by a user by vaporizing different amounts of different vapor precursor materials having different flavor characteristics, wherein the method comprising:

generating a vapor using a selected ratio of the different vapor precursor materials to generate a vapor with a selected flavor characteristic during normal use;

determining that a user notification condition has arisen for the vapor provision system; and in response to determining that the user notification condition has arisen, generating a vapor using a modified ratio of the different vapor precursor materials to generate a vapor with a modified flavor characteristic to provide a user with an indication the user notification condition has arisen.

* * * * *